US006234784B1

(12) United States Patent
Yoshinaga et al.

(10) Patent No.: US 6,234,784 B1
(45) Date of Patent: May 22, 2001

(54) PORTABLE LIGHTER HAVING IGNITER DEVICE EQUIPPED WITH SAFETY LOCK MECHANISM

(75) Inventors: Michinori Yoshinaga; Masahiko Kamegamori, both of Saitama-ken (JP)

(73) Assignee: Yoshinaga Technica Corporation, Tokyo (JP)

( * ) Notice: Subject to any disclaimer, the term of this patent is extended or adjusted under 35 U.S.C. 154(b) by 0 days.

(21) Appl. No.: 09/628,089

(22) Filed: Jul. 28, 2000

(30) Foreign Application Priority Data

Jul. 29, 1999 (JP) ..... 11-214114
Feb. 28, 2000 (JP) ..... 12-051392

(51) Int. Cl.[7] ..... F23D 11/36
(52) U.S. Cl. ..... 431/153; 431/255
(58) Field of Search ..... 431/153, 255, 431/277, 253, 276, 254, 151, 273, 354

(56) References Cited

U.S. PATENT DOCUMENTS 5,145,358 * 9/1992 Shike et al. ..... 431/255
5,240,408 * 8/1993 Uematsu ..... 431/153
5,662,466 * 9/1997 Cheng ..... 431/255
5,829,963 * 11/1998 Ichikawa ..... 431/255
5,885,069 * 3/1999 Rogelet ..... 431/153
6,129,544 * 10/2000 Chen ..... 431/153

* cited by examiner

*Primary Examiner*—James C. Yeung
(74) *Attorney, Agent, or Firm*—Weingarten, Schurgin, Gagnebin & Hayes LLP

(57) ABSTRACT

A safety lighter uses a double release lock mechanism applied to a conventional construction of igniter and valve release. Before the lighter can be activated and a flame produced, a latching collar around the button normally pressed to cause operation of the lighter must be released from a locking position in which this button is locked from being pushed down by an interior set of fingers engaging a ledge. The latching collar is itself locked into the button by the restraint between a first tab and groove latch and is only released by a pressure which disengages this first tab and groove restraint therebetween. With this tab and groove latch released by a strong thumb pressure of the operator that can only be done by an adult, the collar can be slid down to a point where a second tab and groove latch is activated between the button and collar. At this point the latch fingers are forced off the ledge, but downward extending arms of the collar engage the same ledge. The combination of the second tab and groove lock and the collar extensions hitting the ledge continues to prevent the button from being downwardly pushed to cause the hammer to strike the piezo-electric element and to operate the valve release for the liquid gas fuel. Finally, the use of a downward force on the activation button causes the second tab and groove latch to release and at this point the button can travel downward causing the hammer to generate an electrical impulse from the piezo-electric element and the valve to open.

17 Claims, 8 Drawing Sheets

PORTABLE LIGHTER HAVING IGNITER DEVICE EQUIPPED WITH SAFETY LOCK MECHANISM

BACKGROUND OF THE INVENTION

1. Field of the Invention

The present invention relates to portable lighters in which liquefied gas fuel is ignited by means of a discharge spark, and particularly to a portable lighter having an igniter device equipped with a safety lock mechanism.

2. Detailed Description of the Prior Art

There are known portable lighters including cigarette lighters, micro torches and the like (herein referred to as portable lighters) which use high voltage electrical generators utilizing piezo-electric elements as a spark source distinguished from lighters which ignite liquefied gas fuel by means of a discharge spark. The present type of portable lighter generates a high voltage by impacting a piezo-electric element placed between electrodes, close to a gas discharge nozzle, generating a spark. The spark in turn ignites liquefied gas discharged from the nozzle.

FIG. 1 shows a cigarette lighter as a conventional example of this type of portable lighter.

Normally, a lighter main body 1 includes a liquefied gas fuel tank installed thereinside and a high voltage electrical generator 2 on its side. The high voltage electrical generator 2 is composed of a rectangular fixed member 2*a* and a movable member 2*b*. The fixed member 2*a* contains a piezo-electric element 2*c* and an impact hammer 2*d* releasable positioned over that element. The movable member 2*b* is hollow containing a coil spring 2*e* positioned between the hammer 2*d* and the top plate.

In the conventional cigarette lighter, shown in FIG. 1, a plastic casing 3 has an open upper portion integrally formed on the side of the lighter main body 1. The high voltage electrical generator 2 is housed in this casing 3.

The movable member 2*b* is positioned on its upper side and the fixed member 2*a* is inserted lengthwise into the casing 3. An operating button 4 is mounted on top of the movable member 2*b* positioned on the upper side of the lighter main body 1 away from the opening of the casing 3. This operating button 4 is integrally formed with a cover 5 of the high voltage electrical generator 2 shielding the opening of the casing 3.

A lead wire 6 of the high voltage electrical generator 2 is fed upward from the piezo-electric element 2*c*, diagonally to a nozzle 8 of a combustion valve 7 mounted on the upper portion of the lighter main body 1. The tip end 9 of this lead wire 6 functions as a positive (+) electrode that generates a discharge spark between itself and the nozzle 8 that also functions as a negative (−) electrode. Reference numeral 10 designates a lever type valve switch member and is arranged extending across the lower side of and engagable by the operating button 4 and the step portion at the lower side of the valve 8. In the cigarette lighter configured as above, the lighter main body 1 is grasped while the thumb is placed on the operating button 4. When the operating button 4 is pressed by the finger pressure of the thumb, the movable member 2*b* compresses the coil spring 2*e* and opens the combustion valve 7 by pressing down the valve switch member 10.

Next, the hammer 2*d* releases after the movable member 2*b* sufficiently compresses the coil spring 2*e*. The piezo-electric element 2*c* located on the lower side of the movable member 2*b* is then struck by the released hammer 2*d* and a high voltage is generated. This high voltage discharges between the tip end 9 of the lead wire 6 and the nozzle 8, generating a spark which ignites the liquefied gas discharged from the nozzle 8.

The combustion of gas fuel is maintained while pressing the operating button 4. When the thumb releases the operating button 4, the returning force of the coil spring 2*e* returns both the movable member 2*b*, and the valve switch member 10 to their original positions, the combustion valve 7 closes which in turn stops the flow of combustion gas. The hammer 2*d* is returned by the return movement of the movable member 2*b* having a means for holding the hammer 2*d* when returning.

In a cigarette lighter that can use the generation of high voltage to repeatedly ignite liquefied gas from the opening of the combustion valve 7 just by using finger pressure to press down the operating button 4 in this manner, the object of the cigarette lighter can be achieved which is to allow one-handed operation.

Because, however, it is not necessary to strongly press down the operating button 4, the danger exits that the operating button 4 will be inadvertently pressed down at some time causing the lighter to ignite unexpectedly. Further, because a strong grasping or finger pressure force is not required, there are many occasions when the lighter may ignite even with children who have no hand strength. In particular, in households where cigarette lighters are used often, there are many chances when curious children may take a lighter left on a tabletop in the house and copy the way adults use the lighter when they are not supervised. This is a very serious problem that may result in burns or fires.

In the United States, companies are responsible for adding safety mechanisms which do not allow children to use the lighter as measures (child resistance) to prevent the dangers associated with portable lighters such as cigarette lighters and children.

Normally, when considering a safety mechanism, a more complicated construction compared to previous lighters is imagined to ignite the lighter such as a two-action or three-action operation. If the number of operations is increased however, ordinary ignition becomes troublesome and a construction in which both hands are used makes it difficult to use the lighter for cigarettes.

Moreover, children have very keen powers of observation and when adults follow an operations procedure to use a lighter effortlessly without thinking, the steps of the operation from the eyes of a child can be memorized while watching the adult. Consequently, if a lighter is left on a table, there is the possibility that a child may use that lighter, release the safety mechanism and ignite the lighter.

BRIEF SUMMARY OF THE INVENTION

The present invention overcomes the hazards of the prior lighters by the use of a double release lock mechanism applied to the same construction of igniter and valve release as described above. That is an activation mechanism having a button assembly free to move a plunger downward within a cylinder containing a piezo-electric element and force a hammer to strike it with sufficient force to generate a spark creating impulse while the button releases a valve mechanism for the liquid gas container allowing it to escape past an electrode that emits a spark in response to the impulse.

According to the invention, before the lighter can be activated and a flame produced, a latching collar around the button normally pressed to cause operation of the lighter must be released from a locking position in which this button is locked from being pushed down by an interior set of fingers engaging a ledge. The latching collar is itself locked into the button by the restraint between a first tab and groove latch and is only released by a pressure which disengages this first tab and groove restraint therebetween. With this tab and groove latch released by a strong thumb pressure of the operator that can only be done by an adult, the collar can be slid down to a point where a second tab and groove latch is activated between the button and collar. At this point the latch fingers are forced off the ledge, but downward extending arms of the collar engage the same ledge. The combination of the second tab and groove lock and the collar extensions hitting the ledge continues to prevent the button from being downwardly pushed to cause the hammer to strike the piezo-electric element and to operate the valve release for the liquid gas fuel.

Finally, the use of a large downward force on the activation button causes the second tab and groove latch to release and at this point the button can travel downward causing the hammer to generate an electrical impulse from the piezo-electric element and the valve to open. As that happens, the button is latched into the collar again at the first tab and groove position and when finger pressure is released the, collar with the button nested therein, are both urged back upward to the starting position where the latch fingers engage the ledge and activation is prevented.

The nature of the complex release sequence is beyond the grasp of a child's mental prowess but is easily executed by an adult even with a single hand.

Accordingly, it is an object of the invention to provide a portable lighter having an igniter device equipped with a safety lock mechanism for igniting liquefied gas fuel by means of a discharge spark and having a lighter main body with a liquefied gas fuel tank, a combustion valve having a nozzle, electrodes, and a switch for the combustion valve, and an igniter device being composed of a hollow casing integrally formed on the side of a lighter main body, an upper portion thereof being open, a ledge used for locking operation being formed on the inside of the casing at the front and rear below opening in the upward direction, a high voltage electrical generator comprising a fixed member and a hollow movable member, the fixed member containing a piezo-electric element and an impact hammer positioned over that element, the movable member containing a coil spring used for hammer force, the movable member being inserted into the fixed member so as to be slidable, the fixed member being housed lengthwise in the casing with space provided on both sides at the front and the rear while the movable member being set upward away from the opening of the casing, an operating button mounted to the top of the movable member and comprising a top surface, side plates at the lower front and rear sides of the top surface and an end side plate, a lock bar formed of a pair of front and rear plate springs, the upper end of the lock bar being attached to the top portion of the movable member with the operating button, the lower end of the lock bar bending outward and being inserted inside the casing up to a position over the ledge, and a lock release member having an upper portion and a lower portion, the upper portion meshing with three outer surfaces of the operating button except for the surface facing the lighter body, the lower portion thereof meshing with the inner surface of the casing, the lock release member being formed with a U-shaped cross section, a second ledge for the operating button being formed at border of the upper portion and lower portion, the lower portion being mounted to the upper side of the ledge of the casing so as to be slidable while being separated by a desired stroke, wherein the lock release member and the operating button are formed of a resin, and engagement portions being removable by means of elastic deformation of the operating button are provided on the inner and outer side surfaces of the lock release member and the operating button, respectively, with both portions being mutually restrained.

It is a further object of the invention to provide such a portable lighter having an igniter device equipped with a safety lock mechanism, wherein the lock release member is composed of a second ledge for the operating button, formed on the inside of the borders of the upper portion and lower portion, guide protrusions formed on the inside of the open end facing the side plates at the side of the lighter main body, said guide protrusions meshing with longitudinal channels formed between the respective protrusions and the side plates of the operating button, and a transversely long engagement channel formed on the inside of the lock release member adjacent the second ledge at the end plate side as one of said engagement portions, for latching to the latch protrusion of the end plate of the operating button.

It is a further object of the invention to provide such a lighter as a micro torch.

The invention also comprises an igniter for a source of combustible gas with lockout for unauthorized use in claims as filed and having a spark impulse generator having relatively moving parts which when pushed together trigger a voltage impulse used to generate a spark across a gas nozzle; a housing for a source of said gas and having a portion containing said spark impulse generator; a finger actuator coupled to said spark impulse generator and responsive to finger pressure to push said relatively moving parts together for generation of said impulse; a lock bar associated with said finger actuator and having fingers latched into a recess of said housing in a first position to inhibit the pushing together of said relatively moving parts; a collar at least partially surrounding said finger actuator; said collar and said finger actuator having mutually interacting elements which latch said collar and finger actuator together in either of a first state with said finger actuator nested in said collar and a second state with said finger actuator protruding above said collar; said collar being operator switched from said first state to said second state by finger pressure exerted on said collar; said collar having a latch release bar which forces said lock bar fingers away from said recess to allow said finger actuator to push said relatively moving parts together in said second state; said second state locking said finger actuator and said collar together so as to impede the pushing downward of said finger actuator other than by a substantial finger pressure beyond the capability of the average child; said collar and said finger actuator under said substantial pressure returning to said first state while said finger actuator pushes said relatively moving parts together to generate said impulse; a restoration spring element forcing said relatively moving parts away from each other after the generation of said impulse.

A further object of the invention is to provide a an igniter for a source of combustible gas with lockout for unauthorized use comprising a spark impulse generator having relatively moving parts which when pushed together trigger a voltage impulse used to generate a spark across a gas nozzle; a housing for a source of said gas and having a portion containing said spark impulse generator; a finger actuator coupled to said spark impulse generator and responsive to finger pressure to push said relatively moving parts together for generation of said impulse; a lock bar associated with said finger actuator and said housing in a first position to inhibit the pushing together of said relatively moving parts; an actuator lock associated with said finger actuator; said actuator lock and said finger actuator having mutually interacting elements which latch said collar and finger actuator together in one of a first state and a second state; said actuator lock being operator switched from said first state to said second state by finger pressure; said actuator lock having a latch release which deactivates said lock bar to allow said finger actuator to push said relatively moving parts together in said second state; said second state locking said finger actuator and said actuator lock together so as to impede the pushing downward of said finger actuator other than by a substantial finger pressure beyond the capability of the average child; said actuator lock and said finger actuator under said substantial pressure returning to said first state while said finger actuator pushes said relatively moving parts together to generate said impulse; a restoration element forcing said relatively moving parts away from each other after the generation of said impulse.

BRIEF DESCRIPTION OF THE SEVERAL VIEWS OF THE DRAWING

These and other objects and advantages of the present invention will become clear from the following description with reference to the accompanying drawings, wherein.

DETAILED DESCRIPTION OF THE INVENTION

Figure 8:
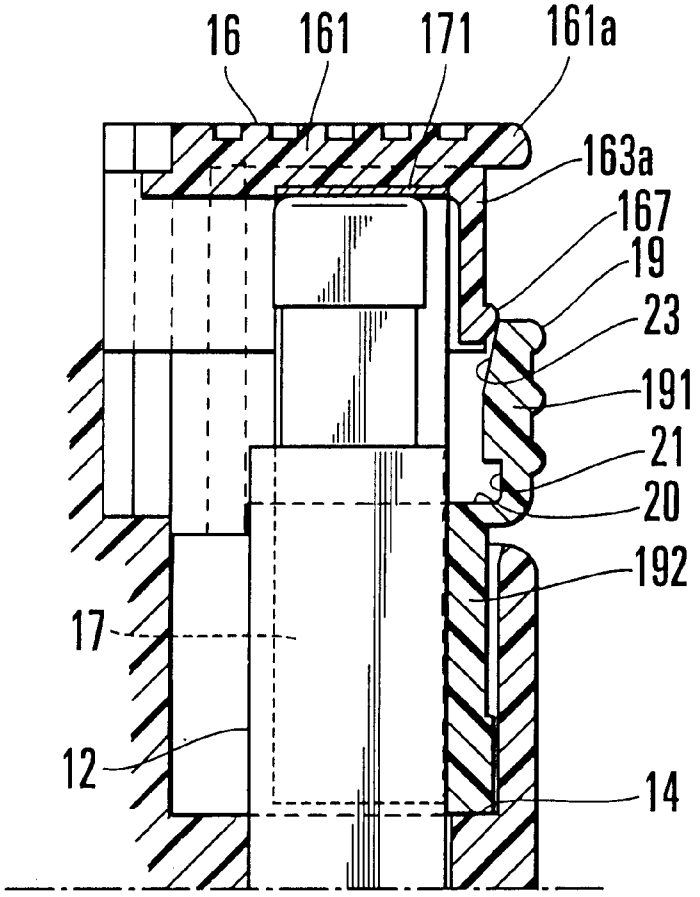
FIG. 8 is a longitudinal side view of another embodiment according to the present invention.
Figure 9:
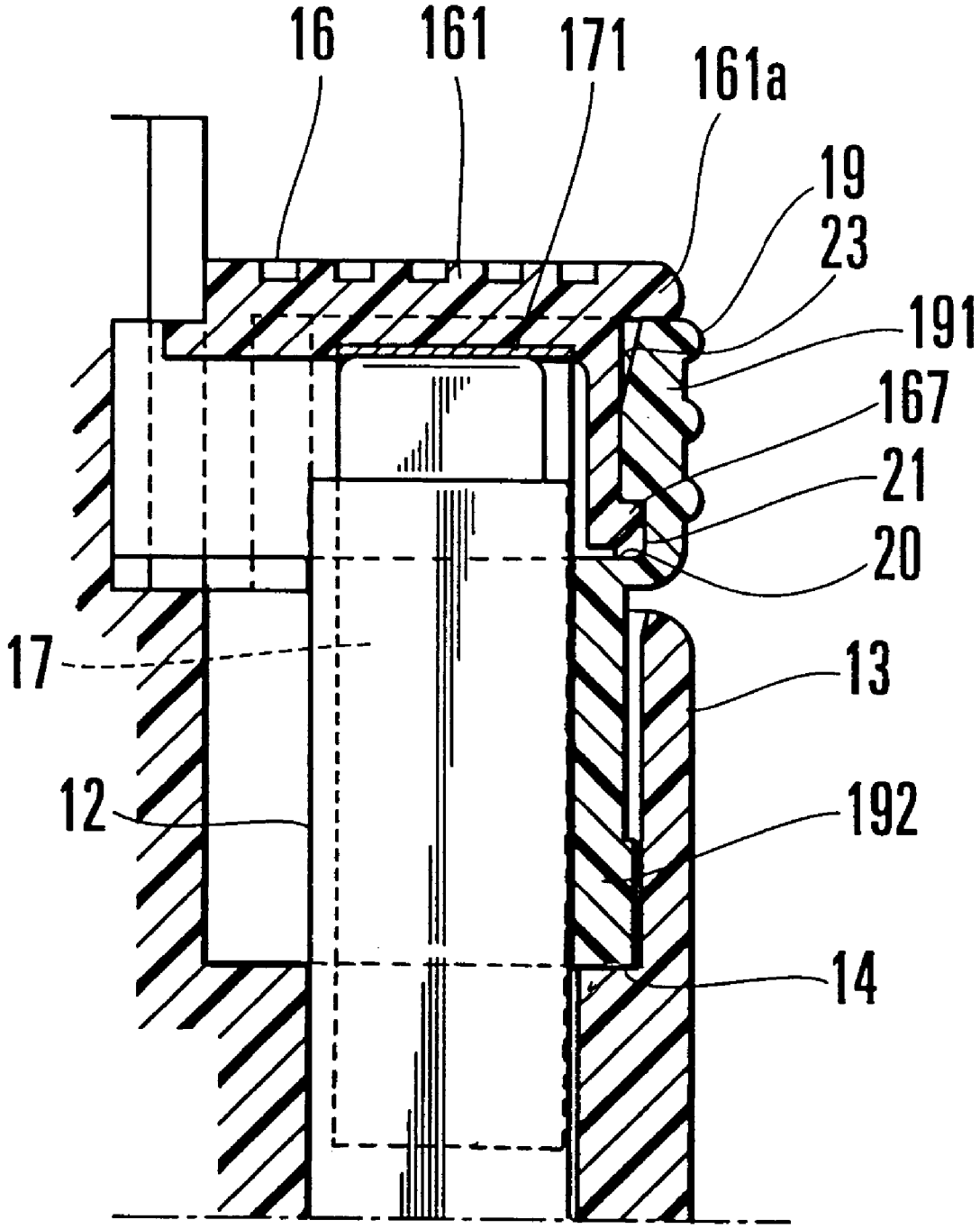
FIG. 9 is a longitudinal front view showing an engaged state between the operating button at the pressed down position of the movable member and the lock release member of another embodiment according to the present invention.
Figure 10:
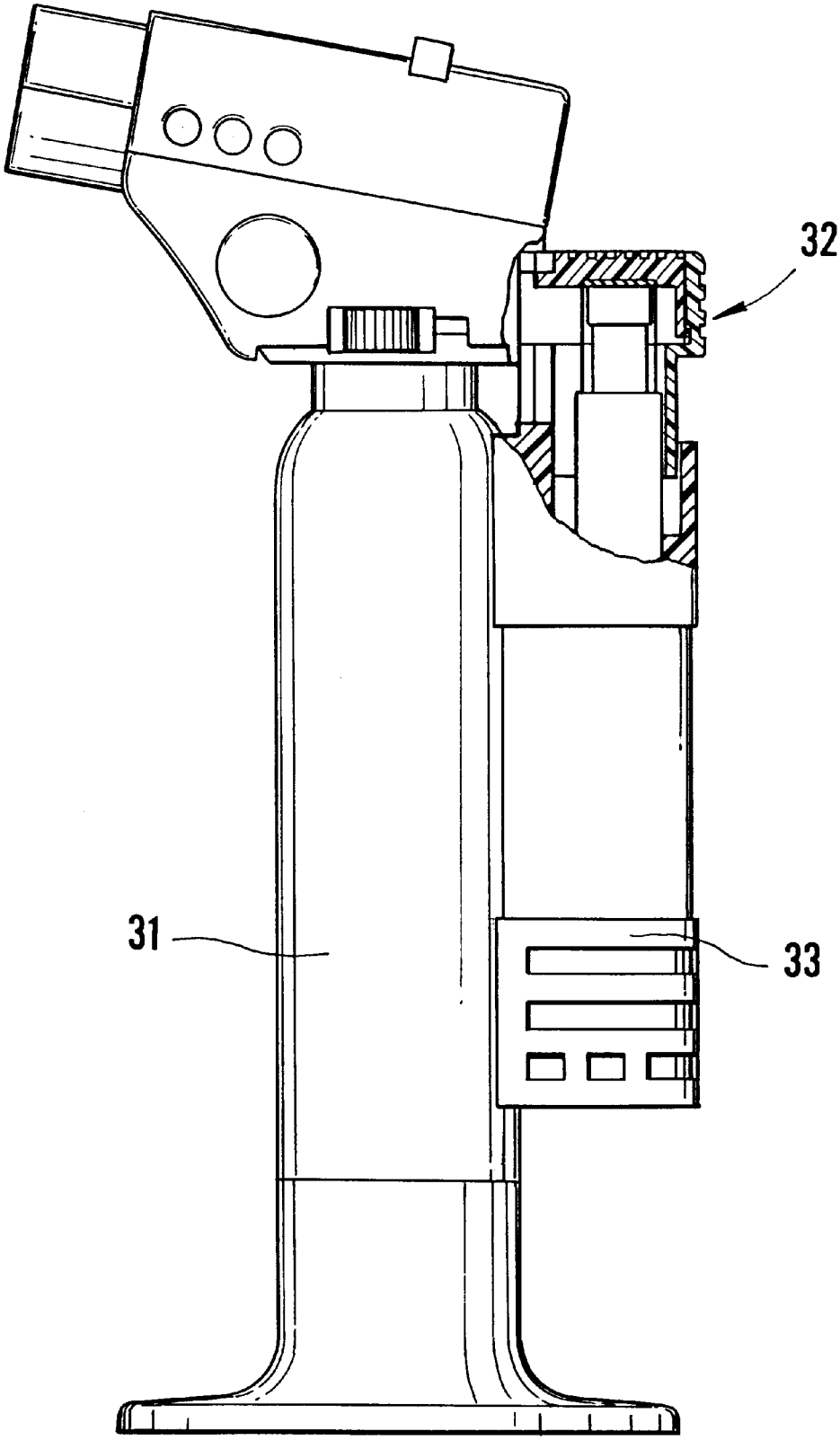
FIG. 10 is a longitudinal sectional front view of the principle parts of a micro torch having an igniter device equipped with a safety lock mechanism according to the present invention.

In the following embodiments of the present invention will be described while referring to the drawings. FIG. 2 to FIG. 6 show a first embodiment and FIG. 7 to FIG. 9 show a second embodiment. Further, FIG. 10 shows a modification to the first embodiment. In the specifications and claims the term "front and rear" are applied to the lighter main body when viewed with the casing located on the right side and the lighter main body located on the left side.

Figure 1:
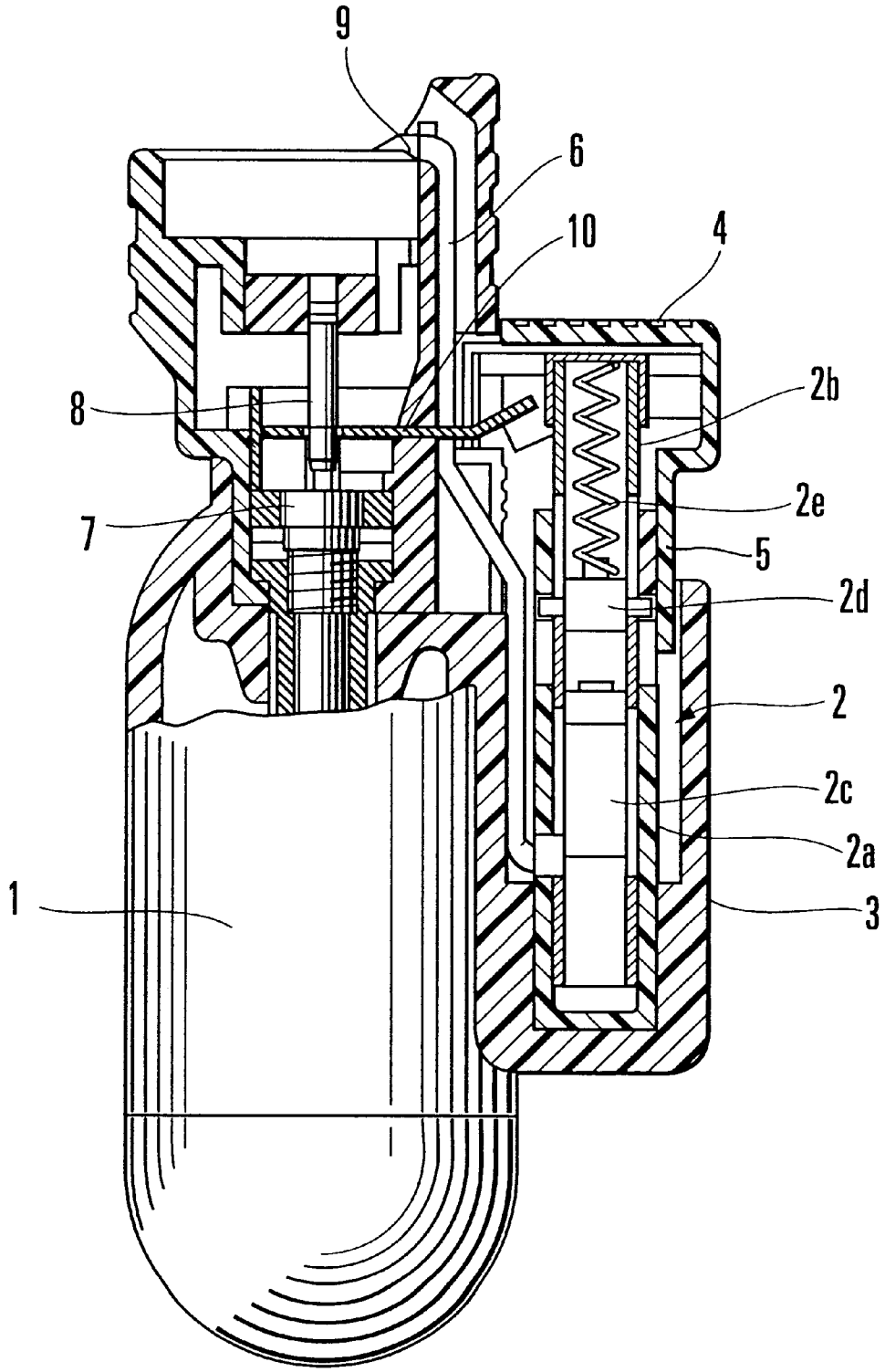
Fig. 1 PRIOR ART
FIG. 1 is a longitudinal sectional front view showing the upper half of a conventional gas lighter equipped with an igniter device having a conventional construction.

In the figures reference numeral 11 designates a lighter main body formed of resin. Although the internal construction of the lighter main body is not shown in the figures, the lighter main body 11 includes a liquefied gas fuel tank, a combustion valve having a nozzle, an electrode (tip end of the lead wire) and a switch member of the combustion valve in like manner to the conventional example shown in FIG. 1.

In the figures, reference numeral 13 designates a casing integrally formed on the side of the lighter main body 11 with the upper portion open and the high voltage electrical generator 12 housed therein. A ledge 14 holds lower fingers of a U-shaped lock bar 17 for locking the unit against unintended operation. Ledge 14 is formed facing upward on the front and rear inside surfaces of the casing 13 beneath the opening thereof.

The high voltage electrical generator 12 is of conventional construction and has a lower fixed member 121 of rectangular cross-section and an upper movable member 122. The fixed member 121 houses a piezo-electric generator element and an impact hammer positioned over that element. The movable member 122 is hollow and contains a coil spring used to provide a hammer force to the piezo-electric element and positioned between the hammer and a top plate of the movable member 122. Member 122 is inserted into the fixed member 121 and is able to slide therein. Further, the piezo-electric element, the hammer and the coil spring are identical to the corresponding parts in the conventional example shown in FIG. 1 and thus are omitted from FIG. 2 to FIG. 10.

The fixed member 121 of the high voltage electrical generator 12 is located on the side casing 13 of the lighter main body 11 and provides a space 15 (see FIG. 3) to accommodate the lock bar 17 fingers when released from ledge 14 as described below.

The operating button or cap 16 fits around an upper portion of the lock bar 17. As shown in the figure, the lock bar 17 may be formed from one piece of spring metal plate bent in a U-shape to fit within cap 16 and having outwardly splayed fingers 174 extend over the fixed member 121 into the ledge 14. A positioning hole is formed on both sides in the upper portion of the lock bar 17 to mate with tabs in cap 16 at 172.

The operating button or cap 16 comprises a top surface 161 for actuation, right and left side plates 162 extending down from the top surface 161 at the front and rear in the view, and an outwardly facing end side plate 163. A protrusion 164 (see FIG. 4) is formed outward on the end of the side plates 162 facing to the lighter main body 11 that guides the operating button 16 vertically while meshing with the vertical channels 18 on both upper sides of the lighter main body 11.

Figure 4:
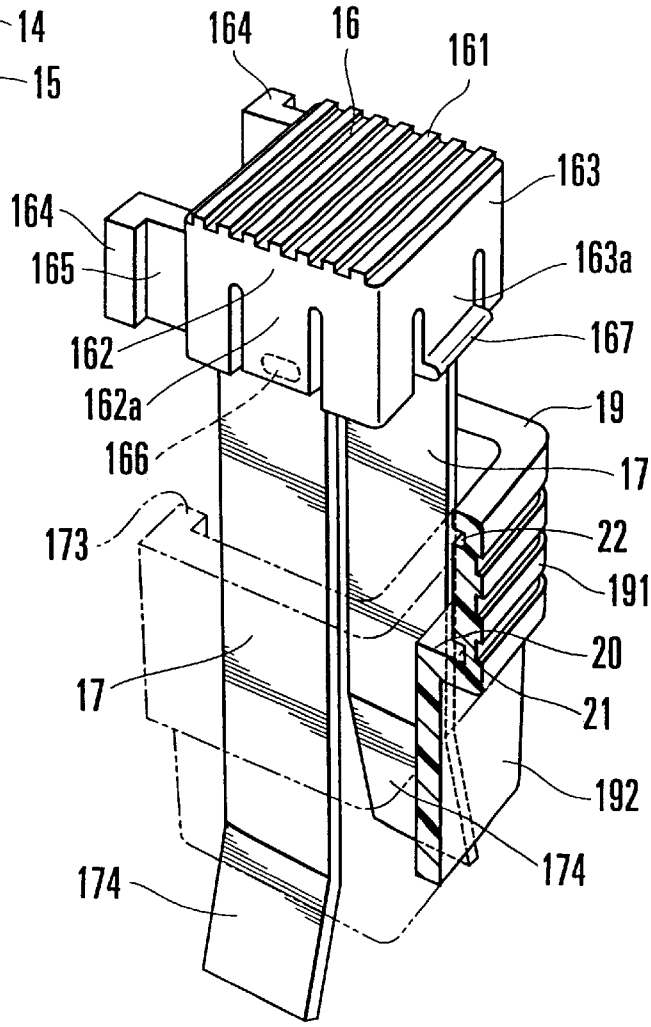
FIG. 4 is a disassembled perspective view showing a cross section of a portion of the operating button and lock piece, and lock release member of the igniter device equipped with a safety lock mechanism according to the present invention.

As further shown in FIG. 4, at the center portion of the side plates 162 and the end plate 163 elastic tabs 162*a*, 163*a* are formed by a pair of right and left kerfs which have openings on the lower ends. A protrusion 166 faces inward to mesh with the hole 172 of lock bar 17. A protrusion 167 in tab 163 sits below lock release member 19 described below.

The top plate 171 of the lock bar 17 is attached such as by gluing or welding to the top surface of the movable member 122. The protrusions 166 of both sides are forced into the mounting holes 172 of the lock bar 17, thereby attaching the operating button 16 to the movable member 122. This prevents pushing down on operating button 16 because lock bar 17 has its fingers 174 blocked by ledge 14.

In the figure reference numeral 19 designates a lock release member formed with a U-shaped cross section in the horizontal plane. It meshes with the outside surfaces of the side plates 162 and the end plate 163 of the operating button 16. The lock release member 19 comprises an upper portion or collar 191 which surrounds three sides of the operating button 16. A long lower portion 192 is integrally formed on the lower side of the upper portion 191 to slide within the inner surface of the casing 13 but outside the latch bar 17 and finger 174. A ledge 20 which halts downward movement of the operating button 16 is formed at the inside of the border of the upper portion and the lower portion.

Guide protrusions 173 are formed on the inside of the open end of the lock release member 19 and mesh with a longitudinal channel 165 which is between the protrusion 164 and side plates 162 of cap 16.

The lock release member 19 when inserted into the casing 13 is movable up and down from the opening with space provided for a desired stroke (FIG. 2) which brings lower portion 192 into contact with the ledge 14 of the casing 13. The wall thickness of the lower portion 192 is formed to be at least the same width as the ledge 14. Thus, when release 19 is forced down, the lower end fingers 174 of the lock bar 17 positioned on top of the ledge 14 are pushed inward off the ledge 14, thereby releasing the lock of the movable member 122 by the lock bar 17 which in turn makes it possible to ignite the lighter by pressing down on the operating button 16. When the lock release 19 is returned back up after use and lock releases (described later), the lock piece 17 is returned onto the ledge 14.

Transverse engagement channel 21 is formed adjacent the support ledge 20 and channel 22 is formed at the top, both facing the end plate 163. At this point, the engagement channel 22 engages with the latch protrusion 167 on the end plate of the operating button 16 to restrain the operating button 16 from passing through the lock release member 19, maintaining a locked state.

The operating button 16 and the lock release 19 may be formed of a thermoplastic resin. It is preferable for the operating button 16 to be formed of a thermoplastic resin such as polyacetal, a glass fiber containing polyamide (for example, nylon 66), which has excellent elastic properties as well as bending strength, creep resistance, wear resistance and fatigue resistance. Although it is also preferable for the lock release member 19 to be formed of the same type of resin as the operating button 16, another thermoplastic resin can be satisfactorily used.

Figure 2:
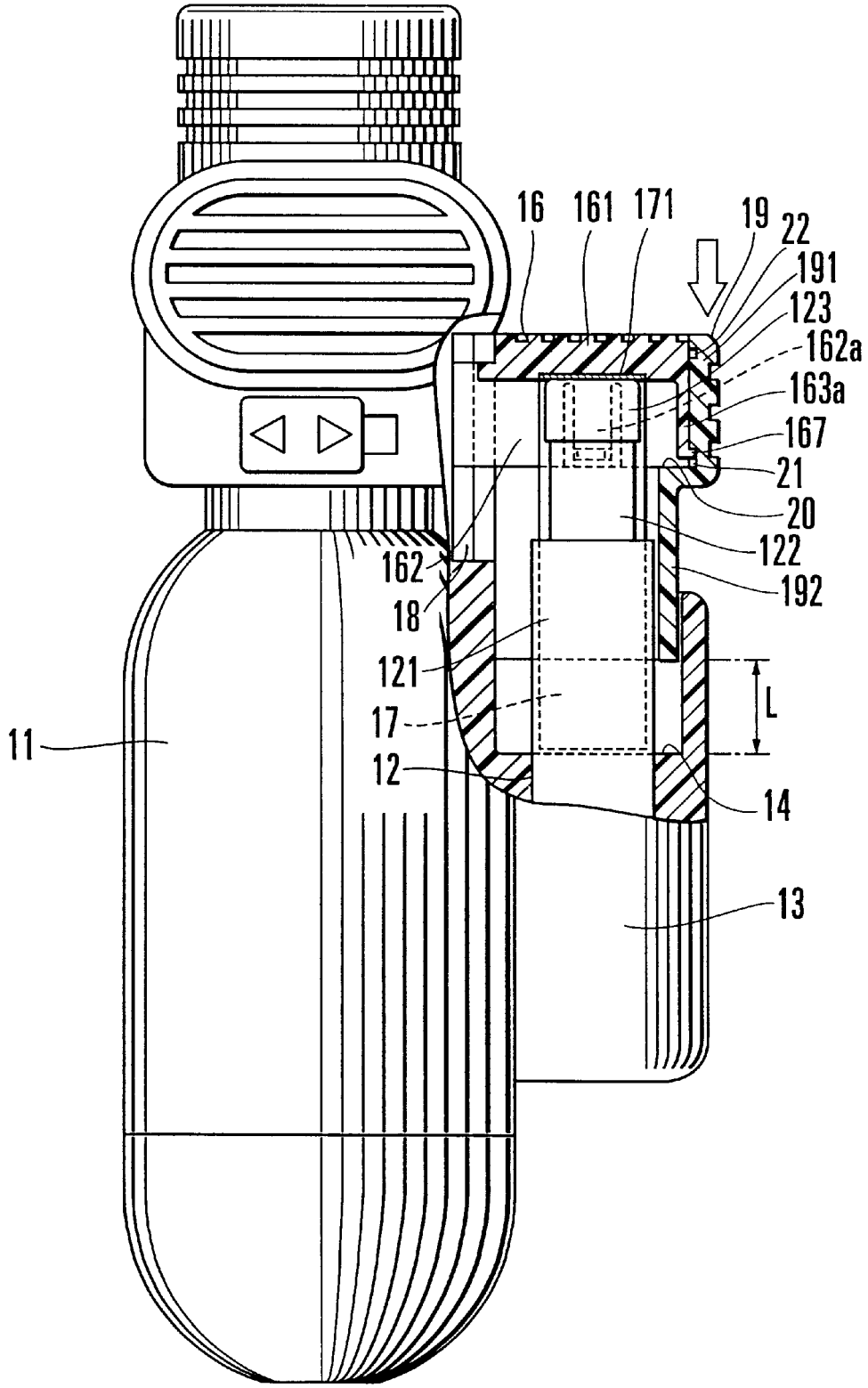
FIG. 2 is a longitudinal sectional front view of the principal parts of a gas lighter having an igniter device equipped with a safety lock mechanism according to the present invention.

The igniter device as described above is installed into casing 13 with the lighter main body 11. With the lock bar 17 securely attached to the top portion of the movable member 122, the high voltage electrical generator 12 is set into the casing 13. The lead wire and valve release level should be as shown in FIG. 2 and are implemented in like manner to the conventional construction of FIG. 1.

Next, the lock release member 19 is placed over the movable member 122 and the lower portion 192 is inserted into the space above the ledge 14 of the casing 13 outside of the lock bar 17. At this time the lower end 196 of the lock release member 19 is strongly forced down to meet the ledge 14 while the lower fingers of the lock bar 17 are pressed in thereby. Thus, the lower portion 192 is retained between the lock bar 17 and the casing 13. The top portion 123 of the movable member 122 protrudes from the upper portion 191 of lock release member 19.

The operating button 16 is placed over the top portion 123 and is forcibly pressed down over the movable member 122 so that the latch protrusion 166 of the side plate 162 of the operating button 16 slips into the holes 172 of the lock bar 17 for retention there. This completes the integration procedure of the lighter main body with the igniter device.

Figure 6B:
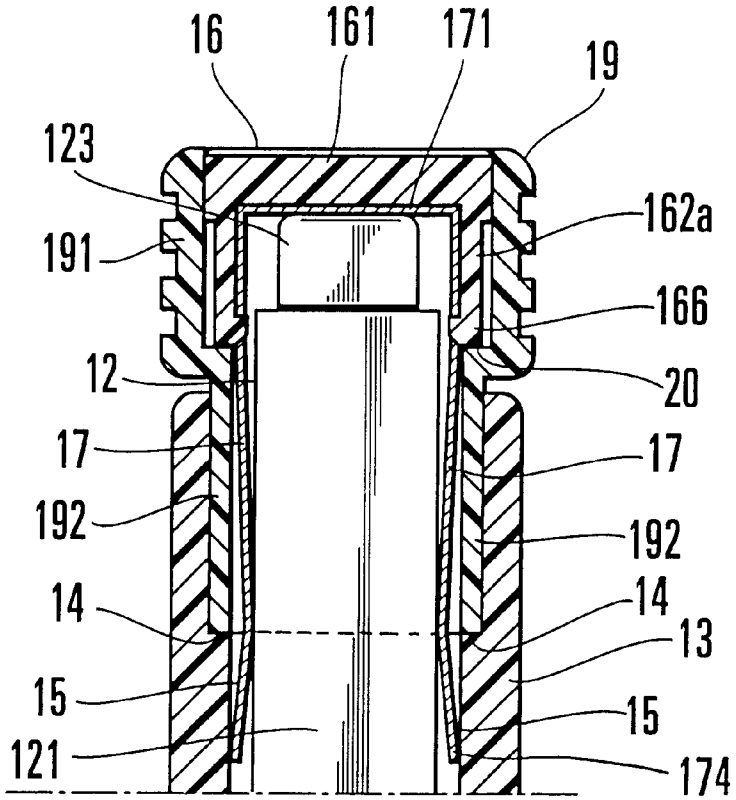
FIGS. 6(A) and 6(B) are a longitudinal front view and a longitudinal side view, respectively, showing an engaged state between the operating button at the pressed down position of the movable member and the lock release member.
Figure 6A:
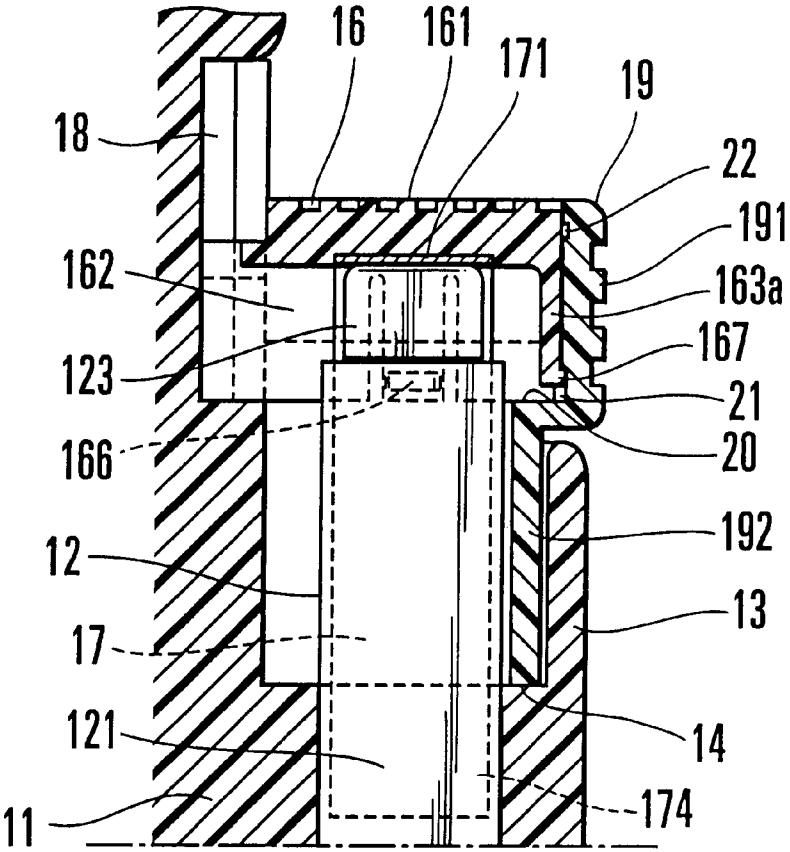
Figure 7:
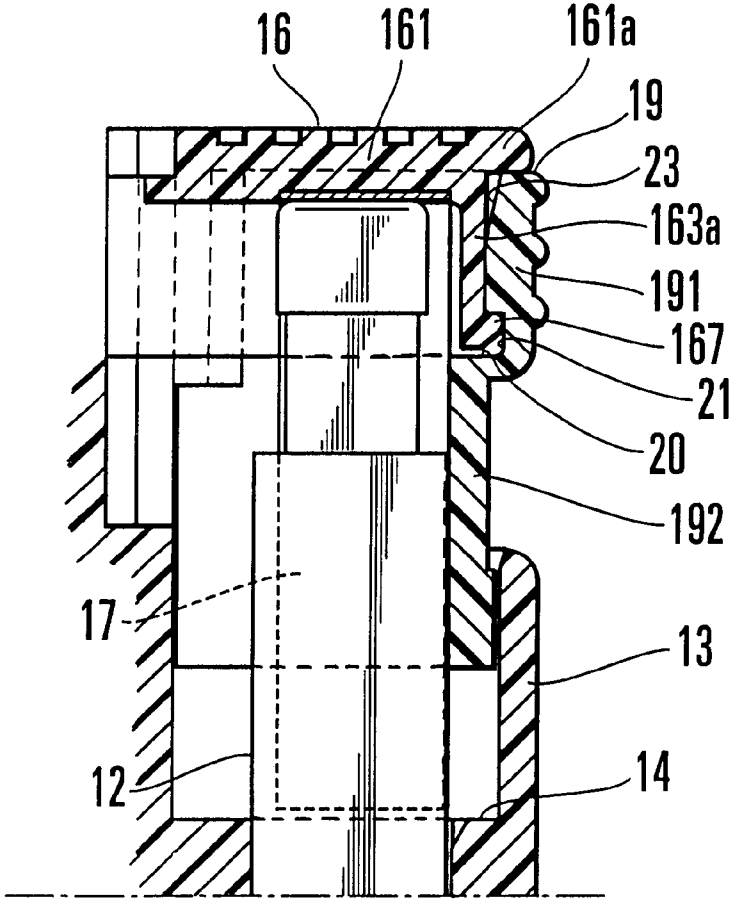
FIG. 7 is a longitudinal front view before releasing the lock of another embodiment according to the present invention.

At this point, the operating button 16 is pressed down and nested in the upper portion 191 of the lock release member 19 with the tab 167 in the groove 21, as shown in FIGS. 6(A) and 6(B).

Figure 3:
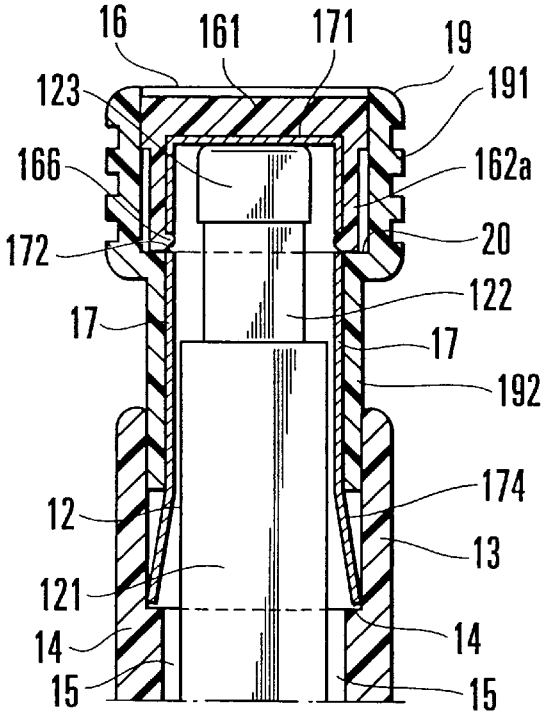
FIG. 3 is a longitudinal sectional side view of the igniter device in FIG. 2.

With no operator pushing on operating button 16, it, together with lock release member 19 and movable member 122, is pushed upward by means of the return force of the impact coil spring compressed inside the movable member 122 to a position shown in FIG. 3.

In this state, even if the operating button 16 is pressed again, the lower end fingers 174 of the lock bar 17 strikes the ledge 14 preventing the movable member 122 from lowering and activating the lighter.

In this locked state, the lighter cannot be ignited even if the operating button 16 of the lighter is pressed.

In order to release the locked state during use, multi-step release procedure is required. The first step is to release the lock release member 19 that is restrained from moving downward by being latched to the operating button 16. To unlatch the button 16 and release 19, the lighter main body 11 is grasped and the thumb is placed on the upper portion 191 of the lock release member 19 facing away from the body 11.

Sufficient thumb pressure at the point on portion 191 requires adult strength to elastically deform the parts and release the latch formed by protrusion 167 of the operating button 16 and the engagement channel 21 adjacent the support level portion 20 of the lock release member 19. Given the fact that releasing the restraint of the lock release member 19 is very hard, it is difficult for children who do not have sufficient finger pressure to press down the lock release member 19. Further, because this operation is done in the palm of the hand, children cannot learn the process just by observing others.

Figure 5B:
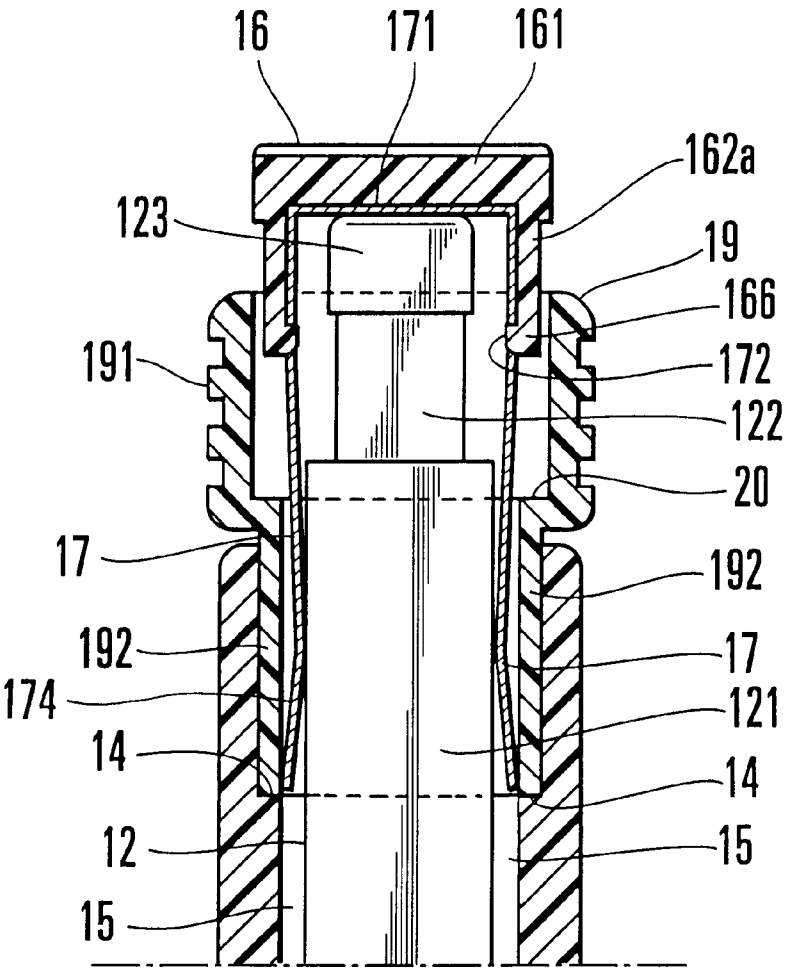
FIGS. 5(A) and 5(B) are a longitudinal front view and a longitudinal side view, respectively, when the lock release member releases the lock of a movable member.

The lock release member 19, once freed from the operating button 16, is forced downward by the thumb. The lower end fingers 174 of the lock bar 17 are forced into the above-mentioned space 15 off the ledge 14 by the downward motion of the lower portion 192 as shown in FIG. 5(B). A significant finger pressure is needed to move release 19 downward.

Figure 5A:
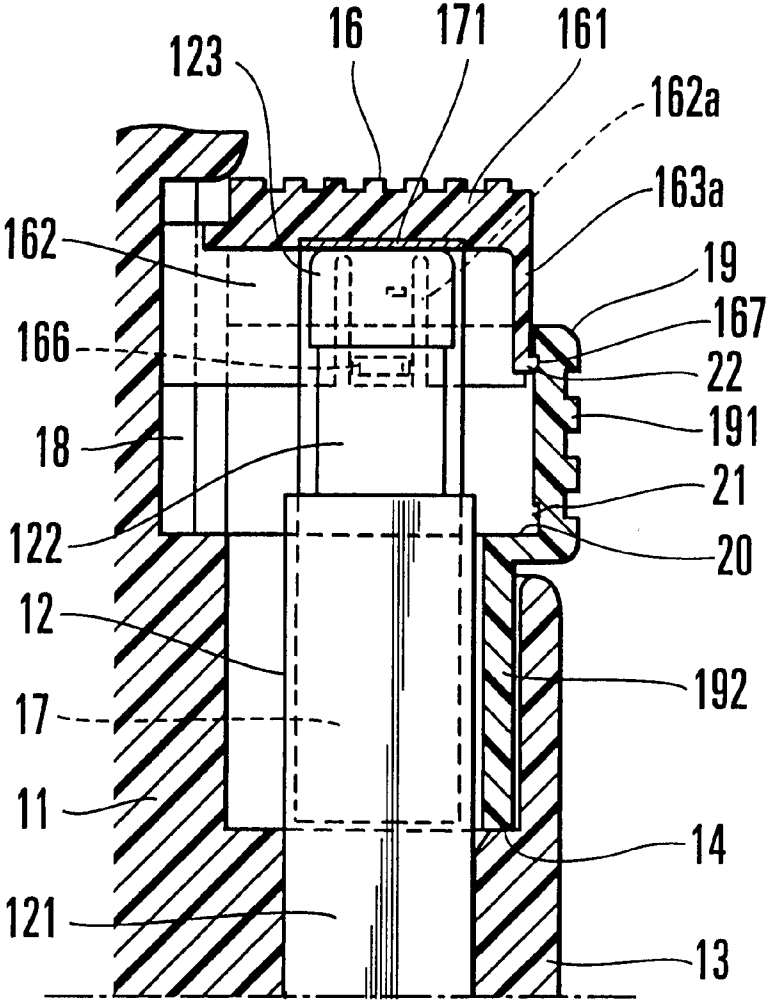

When the lower end of the lock release member 19 reaches the ledge 14, as shown in FIG. 5(A), a new latching up occurs as latch protrusion 167 engages the channel 22. The movable member 122 is thus still restrained by the latching of lock release member 19 with the operating button 16.

This latch can be released by switching the thumb to the top of the button 16 onto the plate 161 and pressing down on that plate with substantial force that causes the elastic piece 163*a* of the end plate 163 to elastically displace. This action, which in turn requires a strong finger pressure, releases tab 167 from channel 22.

The movable member 122 is thus finally released and is pressed down to open the combustion valve in like manner to a conventional lighter and hammer the piezo-electric element to generate a high voltage to ignite the liquefied gas discharged from the nozzle.

The operating button 16 with finger pressure released, is urged back up to be nested in release member 19 at the first latch position with tab 167 in channel 21 by the coil spring inside movable element 122, restoring the condition of FIG. 3. Simultaneously the lower end fingers 174 of the lock bar 17 spring outward to engage ledge 14 thereby restraining the movable member 122 from moving downward and locking it to the casing 13.

A special locking operation after using the lighter is not required. By releasing the thumb from the operating button 16, the flame is extinguished by closing the valve and the lighter igniter device locked. Because of this function, there is never an occasion when locking the lighter is forgotten.

The embodiment shown in FIG. 7 to FIG. 9 is constructed with a peripheral edge 161*a* of the finger plate 161 of the operating button 16 formed as an overhanging eave protrusion overlapping the upper edge of the lock release member 19 and allowing the thick part of the thumb to be used to operate the side end surface of the lock release member 19, providing additional safety. This construction further prevents learning of the lock release operation from outside observation.

Furthermore, by replacing the engagement channel 22 of the upper portion of the lock release member 19 with a tapered surface 23, the ignition operation after releasing the movable member 122 locked by the lock bar 17 by pressing down on the lock release member 19 requires a great deal of finger pressure. This finger pressure must also be quite strong to cause the latch protrusion 167 as it moves downward beyond the tapered surface 23, to inwardly deform the elastic portion 163*a* of the end plate 163. When button 16 is fully pressed down with the lower end of the lock release member 19 on ledge 14, the latch protrusion 167 returns to its original latch position in the engagement channel 21 providing a mutual restraint.

Thus, in an igniter device equipped with a safety lock that allows ignition by the operation of the movable member 122 of the high voltage electrical generator 12 after a multi-step lock release operation, each member of the lock release including the lock release member 19, the lock bar 17 and the operating button 16 require a strong finger pressure. Therefore, grasping and finger pressure by children who lack the strength makes it difficult to operate the lighter, giving it excellent child safety characteristics.

In FIG. 10, a micro torch (portable burner device) having an igniter device equipped with a safety lock mechanism according to the invention is shown. The micro torch is composed of a micro torch main body 31 and an igniter device 32 housed in a casing 33 provided on the side of the microtorch main body 31. In the main body 31, a liquefied gas fuel tank, a combustion valve having a combustion nozzle, which valve can open/close by the action of the igniter device 32, a switch member for the combustion valve, electrodes for discharging a spark and the like are housed, all typically as shown above. When the igniter device 32 is operated, the combustion valve is opened to discharge the gas fuel followed by the ignition by means of the discharge spark.

In this embodiment, the igniter device 32 equipped with a safety lock mechanism of the same configuration as that of the FIGS. 2–6.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A portable lighter having an igniter device equipped with a safety lock mechanism for igniting liquefied gas fuel by means of a discharge spark, said portable lighter comprising a lighter main body and an igniter device, said lighter main body being composed of a liquefied gas fuel tank, a combustion valve having a nozzle, electrodes of a tip of lead wire, and a switch member for the combustion valve, and said igniter device being composed of:

a hollow casing integrally formed on the side of a ligher main body, an upper portion thereof being open, a ledge used for locking operation being formed on the inside of the casing at the front and rear opening in the upward direction, a high voltage electrical generator comprising a fixed member and a hollow movable member, the fixed member containing a piezo-electric element and an impact hammer positioned over that element thereinside, the movable member containing a coil spring used for hammer force, the movable member being inserted into the fixed member so as to be slidable, the fixed member being housed lengthwise in the casing with space provided on both sides at the front and the rear while the movable member being set upward away from the opening of the casing, an operating button mounted to the top of the movable member, said operating button comprising a top surface, side plates at the lower front and rear sides of the top surface and an end side plate, a lock bar formed of a pair of front and rear plate springs, the upper end of the lock bar being attached to the top portion of the movable member with the operating button, the lower end of the lock bar bending outward and being inserted inside the casing up to a position over the ledge, and a lock release member having an upper portion and a lower portion, the upper portion meshing with three outer surfaces of the operating button except for the surface facing the lighter body, the lower portion thereof meshing with the inner surface of the casing, the lock release member being formed with a U-shaped cross section, a second ledge for the operating button being formed at border of the upper portion and lower portion, the lower portion being mounted to the upper side of the ledge of the casing so as to be slidable while being separated by a desired stroke, wherein the lock release member and the operating button being formed of a resin, and engagement portions being removable by means of elastic deformation of the operating button are provided on the inner and outer side surfaces of the lock release member and the operating button, respectively, with both portions being mutually restrained.

2. The portable lighter having an igniter device equipped with a safety lock mechanism according to claim 1, wherein protrusions are formed outward on the end of said side plates facing to the lighter main body, for guiding the operating button vertically while meshing with vertical channels on both upper sides of the lighter main body, and an elastic piece is formed on the center portion of the end side plate by a pair of right and left kerfs which have openings on the lower ends, and a locking latch protrusion is transversely formed so as to protrude outward on the lower end of the elastic piece, said latch protrusion functioning as one of said engagement portions.

3. The portable lighter having an igniter device equipped with a safety lock mechanism according to claim 2, wherein the peripheral edge of said top surface is formed as an eave-shaped protruding edge overlapping the upper edge of said lock release member, thereby concealing the upper edge of the lock release member.

4. The portable lighter having an igniter device equipped with a safety lock mechanism according to claim 1, wherein the lock bar is formed from one wherein a rectangular plate spring is being evenly at the right and left to a length reaching from the top surface of the movable member to the ledge of the casing leaving a top plate and the lower end portion is bent outward so as to be positioned at the ledge.

5. The portable lighter having an igniter device equipped with a safety lock mechanism according to claim 2, wherein the lock release member is composed of a second ledge for the operating button, formed on the inside of the borders of the upper portion and lower portion, guide protrusions formed on the inside of the open end facing the side plates at the side of the lighter main body, said guide protrusions meshing with longitudinal channels formed between the respective protrusions and the side plates of the operating button, and a transversely long engagement channel formed on the inside of the lock release member adjacent the second ledge at the end plate side as one of said engagement portions, for latching to the latch protrusion of the end plate of the operating button.

6. The portable lighter having an igniter device equipped with a safety lock mechanism according to claim 1, wherein the lower portion of the lock release member has a wall thickness at least the same width as the ledge and is inserted in the casing to be movable up and down to be capable of pressing back the bent lower end of the lock bar positioned over the latch portion to said space and to have a desired movable stroke that is used to release the lock of the movable member by the lock bar.

7. The portable lighter having an igniter device equipped with a safety lock mechanism according to claim 5, wherein the upper portion of the lock release member has said engagement channel formed in a concave shape adjacent the second ledge at the end plate side and a transversely long engagement channel for engaging with the latch protrusion of the end plate of the operating button, located on the upper inner surface thereof separated by a distance equal to the movable stroke.

8. The portable lighter having an igniter device equipped with a safety lock mechanism according to claim 5, wherein the upper portion of the lock release member has the above-mentioned engagement channel formed in a concave shape above the second ledge at the end plate side, and a tapered surface which enables to inwardly deform an elastic piece at the center of the end plate of the operating button formed on the inner surface of the end plate using a pressing force through the latch protrusion, formed above the engagement channel.

9. The portable lighter having an igniter device equipped with a safety lock mechanism according to any one of claim 1, 2, 4, 5, 7 or 8, wherein said portable lighter is a cigarette lighter.

10. The portable lighter having an igniter device equipped with a safety lock mechanism according to claim 3, wherein said portable lighter is a cigarette lighter.

11. The portable lighter having an igniter device equipped with a safety lock mechanism according to claim 6, wherein said portable lighter is a cigarette lighter.

12. The portable lighter having an igniter device equipped with a safety lock mechanism according to any one of claim 1, 2, 4, 5, 7 or 8, wherein said portable lighter is a micro torch.

13. The portable lighter having an igniter device equipped with a safety lock mechanism according to claim 3, wherein said portable lighter is a micro torch.

14. The portable lighter having an igniter device equipped with a safety lock mechanism according to claim 6, wherein said portable lighter is a micro torch.

15. The portable lighter having an igniter device equipped with a safety lock mechanism according to claim 5, wherein the lower portion of the lock release member has a wall thickness at least the same width as the ledge and is inserted in the casing to be movable up and down to be capable of pressing back the bent lower end of the lock bar positioned over the latch portion to said space and to have a desired movable stroke that is used to release the lock of the movable member by the lock bar.

16. An igniter for a source of combustible gas with lockout for unauthorized use comprising:

a spark impulse generator having relatively moving parts which when pushed together trigger a voltage impulse used to generate a spark across a gas nozzle;

a housing for a source of said gas and having a portion containing said spark impulse generator;

a finger actuator coupled to said spark impulse generator and responsive to finger pressure to push said relatively moving parts together for generation of said impulse;

a lock bar associated with said finger actuator and having fingers latched into a recess of said housing in a first position to inhibit the pushing together of said relatively moving parts;

a collar at least partially surrounding said finger actuator;

said collar and said finger actuator having mutually interacting elements which latch said collar and finger actuator together in either of a first state with said finger actuator nested in said collar and a second state with said finger actuator protruding above said collar;

said collar being operator switched from said first state to said second state by finger pressure exerted on said collar;

said collar having a latch release bar which forces said lock bar fingers away from said recess to allow said finger actuator to push said relatively moving parts together in said second state;

said second state locking said finger actuator and said collar together so as to impede the pushing downward of said finger actuator other than by a substantial finger pressure beyond the capability of the average child;

said collar and said finger actuator under said substantial pressure returning to said first state while said finger actuator pushes said relatively moving parts together to generate said impulse;

a restoration spring element forcing said relatively moving parts away from each other after the generation of said impulse.

17. An igniter for a source of combustible gas with lockout for unauthorized use comprising.

a spark impulse generator having relatively moving parts which when pushed together trigger a voltage impulse used to generate a spark across a gas nozzle;

a housing for a source of said gas and having a portion containing said spark impulse generator;

a finger actuator coupled to said spark impulse generator and responsive to finger pressure to push said relatively moving parts together for generation of said impulse;

a lock bar associated with said finger actuator and said housing in a first position to inhibit the pushing together of said relatively moving parts;

an actuator lock associated with said finger actuator;

said actuator lock and said finger actuator having mutually interacting elements which latch said collar and finger actuator together in one of a first state and a second state;

said actuator lock being operator switched from said first state to said second state by finger pressure;

said actuator lock having a latch release which deactivates said lock bar to allow said finger actuator to push said relatively moving parts together in said second state;

said second state locking said finger actuator and said actuator lock together so as to impede the pushing downward of said finger actuator other than by a substantial finger pressure beyond the capability of the average child;

said actuator lock and said finger actuator under said substantial pressure returning to said first state while said finger actuator pushes said relatively moving parts together to generate said impulse;

a restoration element forcing said relatively moving parts away from each other after the generation of said impulse.

* * * * *

UNITED STATES PATENT AND TRADEMARK OFFICE

CERTIFICATE OF CORRECTION

PATENT NO. : 6,234,784 B1
DATED : May 22, 2001
INVENTOR(S) : Michinori Yoshinaga et al.

It is certified that error appears in the above-identified patent and that said Letters Patent is hereby corrected as shown below:

Title page,
Item [30], Foreign Application Priority Data, "11-214114" should read -- 11-215114 -- ; and "12-051392" should read -- 2000-51392 --.

Signed and Sealed this

Seventeenth Day of September, 2002

*Attest:*

*Attesting Officer*

JAMES E. ROGAN
*Director of the United States Patent and Trademark Office*